US006133340A

United States Patent [19]

Menon

[11] Patent Number: 6,133,340

[45] Date of Patent: Oct. 17, 2000

[54] SLEEVES, THEIR PREPARATION, AND USE

[75] Inventor: Paulo Roberto Menon, San Paulo, Brazil

[73] Assignee: Ashland Inc., Dublin, Ohio

[21] Appl. No.: 08/952,791

[22] PCT Filed: Mar. 21, 1997

[86] PCT No.: PCT/US97/04628

§ 371 Date: Oct. 21, 1998

§ 102(e) Date: Oct. 21, 1998

[87] PCT Pub. No.: WO97/35677

PCT Pub. Date: Oct. 2, 1997

[30] Foreign Application Priority Data

Mar. 25, 1996 [BR] Brazil ..... 9601454

[51] Int. Cl.[7] ..... B22C 9/08; C08K 7/18

[52] U.S. Cl. ..... 523/139; 164/138; 523/141; 523/142; 523/143; 523/218; 524/441; 524/444

[58] Field of Search ..... 164/138; 523/141, 523/142, 143, 218, 139; 524/441, 444

[56] References Cited

U.S. PATENT DOCUMENTS

| | | | |
|---|---|---|---|
| 3,409,579 | 11/1968 | Robins | 260/30.4 |
| 3,485,797 | 12/1969 | Robins | 260/57 |
| 4,179,427 | 12/1979 | Gardikes | 260/29.2 TN |
| 4,240,496 | 12/1980 | Gammal | 164/138 |
| 4,268,425 | 5/1981 | Gardikes | 260/19 A |
| 4,352,856 | 10/1982 | Smillie | 428/329 |
| 4,526,219 | 7/1985 | Dunnavant et al. | 164/16 |
| 4,574,869 | 3/1986 | Trinkl et al. | 164/130 |
| 4,767,800 | 8/1988 | Neu et al. | 523/141 |
| 4,874,726 | 10/1989 | Kleeb et al. | 501/124 |
| 4,928,746 | 5/1990 | Butler et al. | 164/362 |
| 5,252,526 | 10/1993 | Wnittemore | 501/127 |
| 5,364,570 | 11/1994 | Chadwick et al. | 264/28 |

FOREIGN PATENT DOCUMENTS

| | | | |
|---|---|---|---|
| 0086615 | 2/1983 | European Pat. Off. | B22C 1/16 |
| 2121353 | 11/1972 | Germany . | |
| 6-198384 | 12/1982 | Japan . | |
| 1435374 | 11/1988 | Russian Federation | B22C 9/10 |
| 922505 | 4/1963 | United Kingdom . | |
| 1279096 | 6/1972 | United Kingdom . | |
| 1283692 | 8/1972 | United Kingdom . | |
| 2001658 | 2/1979 | United Kingdom | C08V 7/10 |
| 2096928 | 10/1982 | United Kingdom . | |
| WO94/23865 | 10/1994 | WIPO | B22D 7/10 |
| WO98/03284 | 1/1998 | WIPO | B22D 7/10 |

OTHER PUBLICATIONS

Armoform Marketing Limited International (a.m.l) Armo Spheres Products Armospheres in Refractories and Metallurgical Insulation (Date Unknown).

The PQ Corporation, Hollow Spheres Ceramic, Castables With Extendosogeres® SG and SLG Hollow Spheres, Bulletin No. PA–227/1095 (Date Unknown).

Atmoform Marketing Limited International (a.m.r.) Armo Spheres Products, SL–150 White Hollow Microspheres (Date Unknown).

The PQ Corporation, Hollow Spheres Ceramic, Extendospheres®SLG in Refreshory (Date Unknown).

The PQ Corporation, Extendospheres®SL Hollow Microspheres (Date Unknown).

A. Konieszcy, W. Rakowski, Z. Ignaszak, A. Baranowski, Translation of Polish Paper published in *Przeglad Odlewnictwa,* May 1989, pp. 172–176.

*Primary Examiner*—Andrew E. C. Merriam
*Attorney, Agent, or Firm*—David L. Hedden

[57] ABSTRACT

This invention relates to exothermic and/or insulating sleeves, their method of preparation, and their use. The sleeves are prepared by shaping a sleeve mix comprising (1) a sleeve composition capable of providing a sleeve, and (2) a chemical binder. The sleeves are cured in the presence of a catalyst by the cold-box or no-bake curing process. The invention also relates to a process for casting metal parts using a casting assembly where the sleeves are a component of the casting assembly. Additionally, the invention relates to the metal parts produced by the casting process.

27 Claims, 2 Drawing Sheets

* CARBON STEEL ≈ 0.25%C

SLEEVES, THEIR PREPARATION, AND USE

FIELD OF THE INVENTION

This invention relates to exothermic and/or insulating sleeves, their method of preparation, and their use. The sleeves are prepared by shaping a sleeve mix comprising (1) a sleeve composition capable of providing a sleeve, and (2) a chemically reactive binder. The sleeves are cured in the presence of a catalyst by the cold-box or no-bake curing process. The invention also relates to a process for casting metal parts using a casting assembly where the sleeves are a component of the casting assembly. Additionally, the invention relates to the metal parts produced by the casting process.

BACKGROUND OF THE INVENTION

A casting assembly consists of a pouring cup, a gating system (including downsprues, choke, and runner), risers, sleeves, molds, cores, and other components. To produce a metal casting, metal is poured into the pouring cup of the casting assembly and passes through the gating system to the mold and/or core assembly where it cools and solidifies. The metal part is then removed by separating it from the core and/or mold assembly.

The molds and/or cores used in the casting assembly are made of sand or other foundry aggregate and a binder, often by the no-bake or cold-box process. The foundry aggregate is mixed with a chemical binder and typically cured in the presence of a liquid or vaporous catalyst after it is shaped. Typical aggregates used in making molds and/or cores are aggregates having high densities and high thermal conductivity such as are silica sand, olivine, quartz, zircon sand, and magnesium silicate sands. The amount of binder used for producing molds and/or cores from these aggregates on a commercial level is typically from 1.0 to 2.25 weight percent based upon the weight and type of the aggregate.

The density of a foundry mix is typically from 1.2 to 1.8 g/cc while the thermal conductivity of such aggregates typically ranges from 0.8 to 1.0 W/m.K. The resulting molds and/or cores are not exothermic since they do not liberate heat. Although molds and cores have insulating properties, they are not very effective as insulators. In fact, molds and cores typically absorb heat.

Risers or feeders are reservoirs which contain excess molten metal which is needed to compensate for contractions or voids of metal which occur during the casting process. Metal from the riser fills such voids in the casting when metal from the casting contracts. Thus the metal from the riser is allowed to remain in a liquid state for a longer period of time, thereby providing metal to the casting as it cools and solidifies. Sleeves are used to surround or encapsulate the riser and other parts of the casting assembly in order to keep the molten metal in the riser hot and maintain it in the liquid state. The temperature of the molten metal and the amount of time that the metal in the riser remains molten is a function of the sleeve composition and the thickness of the sleeve wall, among other factors.

In order to serve their function, sleeves must have exothermic and/or insulating properties. The exothermic and insulating thermal properties of the sleeve are different in kind and/or degree than the thermal properties of the mold assembly into which they are inserted. Predominately exothermic sleeves operate by liberating heat which satisfies some or all of the specific heat requirements of the riser and limits the temperature loss of the molten metal in the riser, thereby keeping the metal hotter and liquid longer. Insulating sleeves, on the other hand, maintain the molten metal in the riser by insulating it from the surrounding mold assembly.

Foundry molds and cores do not have the thermal properties which enable them to serve the functions of a sleeve. They are not exothermic, are not effective enough as insulators, and absorb too much heat to keep the molten metal hot and liquid. Compositions used in foundry molds and cores are not useful for making sleeves because they do not have the required thermal properties and density.

Typical materials used to make sleeves are aluminum, oxidizing agents, fibers, fillers and refractory materials, particularly alumina, aluminosilicate, and aluminosilicate in the form of hollow aluminosilicate spheres. The type and amount of materials in the sleeve mix depends upon the properties of the sleeves which are to be made. Typical densities of sleeve compositions range from 0.4 g/ml to 0.8 g/ml. The thermal conductivity for aluminum at room temperature is typically greater than 200 W/m.K while the thermal conductivity for hollow aluminosilicate microspheres at room temperature ranges from 0.05 W/m.K to 0.5 W/m.K. To some extent, all sleeves are required to have insulating properties, or combined insulating and exothermic properties in order to minimize heat loss and to maintain the metal in a liquid state for as long a time as possible.

Three basic processes are used for the production of sleeves, "ramming", "vacuuming", and "blowing or shooting". Ramming and blowing are basically methods of compacting a sleeve composition and binder into a sleeve shape. Ramming consists of packing a sleeve mix (sleeve composition and binder) into a sleeve pattern made of wood, plastic, and/or metal. Vacuuming consists of applying a vacuum to an aqueous slurry of a refractory and/or fibers and suctioning off excess water to form a sleeve. Typically, whether ramming, blowing, or vacuuming is used to form the sleeve, the sleeves formed are oven-dried to remove contained water and cure the sleeve. If the contained water is not removed, it may vaporize when it comes into contact with the hot metal and result in a safety hazard. In none of these processes is the shaped sleeve chemically cured with a liquid or vaporous catalyst.

These compositions are modified, in some cases, by the partial or complete replacement of the fibers with hollow aluminosilicate microspheres. See PCT publication WO 94/23865. This procedure makes it possible to vary the insulating properties of the sleeves and reduces or eliminates the use of fibers which can create health and safety problems to workers making the sleeves and using the sleeves in the casting process.

One of the problems with sleeves is that the external dimensions of the sleeves are not accurate. As a result, the external contour of the sleeves does not coincide in its dimensions with the internal cavity of the mold where the sleeve is to be inserted. In order to compensate for the poor dimensional accuracy, it is often necessary to oversize the cavity in the mold where the sleeve is to be inserted, or form or place "crush ribs" in the mold assembly which erode or deform when the sleeves are inserted into the riser cavity to provide a means of locking the sleeve in place. Alternatively, the sleeves are placed in position on the casting pattern and the mold is made around the sleeves, thus avoiding problems with sleeves that are not dimensionally accurate.

Another problem with sleeves is that they may lack the required thermal properties needed to maintain the molten metal in the riser reservoir in a hot and liquid state. The result is that the casting experiences shrinkage which results in casting defects. These casting defects are most likely to be scrapped which results in wasted time and metal.

Runners, sprues, and other components of the casting assembly also can use insulating and exothermic sleeves as coverings to maintain the temperature of the molten metal which comes into contact with them.

SUMMARY OF THE INVENTION

This invention relates to a no-bake and cold-box process for making exothermic and/or insulating sleeves, the sleeves made by this method, and the use of the sleeves in making metal castings. Typically, the steps involved in preparing a sleeve are:

(A) introducing a sleeve mix into a sleeve pattern to form an uncured sleeve wherein said sleeve mix comprises:
  (1) a sleeve composition capable of making a sleeve wherein the sleeve composition comprises:
    (a) an oxidizable metal and an oxidizing agent capable of generating an exothermic reaction;
    (b) an insulating refractory material; and
    (c) mixtures of (a) and (b);
  (2) an effective binding amount of a chemically reactive cold-box or no-bake binder;

(B) contacting the uncured sleeve with a cold-box or no-bake catalyst to allow the sleeves to become self-supporting; and (C) removing said sleeve from the pattern and allowing it to further cure and become a hard, solid, cured sleeve.

In the no-bake process, the curing catalyst is a liquid and is mixed with the sleeve composition, binder, and other components prior to shaping. In the cold-box process, the sleeve mix is first shaped and then contacted with a vaporous curing catalyst. The components of the no-bake and cold-box sleeve mixes can be uniformly mixed so that the mixture maintains its consistency, resulting in a sleeve where the properties are uniform throughout.

The no-bake and cold-box processes result in chemically cured sleeves. The processes result in the higher production of sleeves per unit of time when compared to the processes known in the prior art. Additionally, there is less risk to the health and safety of workers who come into contact with the raw materials and sleeves because they are not exposed to any fibers which may cause breathing problems when ingested for prolonged periods of time.

The invention also relates to the sleeves produced by this process. The sleeves prepared by the process are dimensionally accurate. This allows for easy insertion of the sleeve into the mold. The riser sleeves can be inserted into the mold assembly by automatic methods, thereby further improving the productivity of the molding process. Since the density and thickness of the sleeve are more consistent and dimensionally accurate, the sleeves do not have to be oversized, nor is it necessary to use "crush ribs" or molds with ribs to keep the sleeve in place. Moreover, because the sleeves are sufficiently thermally stable, the castings made with casting assemblies using the sleeves do not contain shrinkage defects. This results in less scrap and greater productivity.

The invention also relates to the casting of ferrous and non ferrous metal parts in a casting assembly of which the sleeves are a part, and to the parts made by this casting process. The casting made using these sleeves results in less waste because the sleeves enable the molten metal in the reservoir of the sleeve riser to be reduced compared to the molten metal contained in the reservoir of a sand riser cavity. Consequently, there is better utilization of the metal in the riser and this allows for additional castings to be made from the same amount of molten metal.

DEFINITIONS

Figure 1:
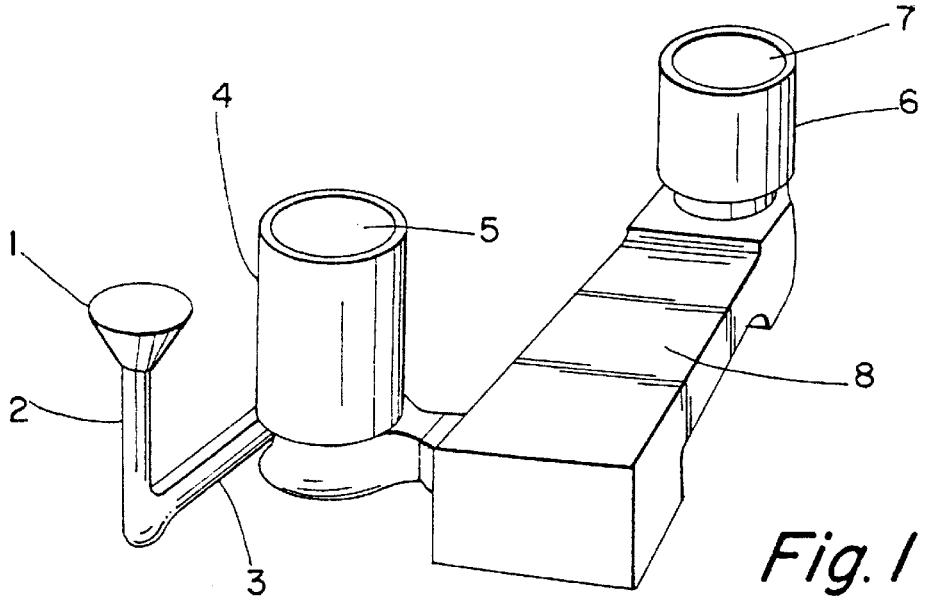
FIG. 1 shows a casting assembly with two riser sleeves (side riser sleeve and top riser sleeve) inserted into the mold assembly of the casting assembly.

The following definitions will be used for terms in the disclosure and claims:

| | |
|---|---|
| Casting assembly | assembly of casting components such as pouring cup, downsprue, gating system (downsprue, runner, choke), molds, cores, risers, sleeves, etc. which are used to make a metal casting by pouring molten metal into the casting assembly where it flows to the mold assembly and cools to form a metal part. |
| Chemical binding | binding created by the chemical reaction of a catalyst and a binder which is mixed with a sleeve composition. |
| Cold-box | mold or core making process which utilizes a vaporous catalyst to cure the mold or core. |
| Downsprue | main feed channel of the casting assembly through which the molten metal is poured. |
| EXACTCAST ® | a two part polyurethane-forming cold-box binder where the Part I is a phenolic resin similar to that described in U.S. Pat. No. 3,485,797. The resin is dissolved in a blend of aromatic, ester, and aliphatic solvents, and a silane. Part II is the polyisocyanate component comprises a polymethylene polyphenyl isocyanate, a solvent blend consisting primarily of aromatic solvents and a minor amount of aliphatic solvents, and a benchlife extender. The weight ratio of Part I to Part II is about 55:45. |
| EXACTCAST ® | a two part polyurethane-forming no-bake binder which is similar to the EXACTCAST ® cold-box binder. EXACTCAST ® no-bake binder does not contain a benchlife extender or silane. |
| Exothermic sleeve | a sleeve which has exothermic properties compared to the mold/core assembly into which it is inserted. The exothermic properties of the sleeve are generated by an oxidizable metal (typically aluminum metal) and an oxidizing agent which can react to generate heat. |
| EXTENDO-SHRERS SG | hollow aluminosilicate microspheres sold by PQ Corporation having a particle size of 10–350 microns and an alumina content between 28% to 33% by weight based upon the weight of the microspheres. |
| EXTENDO-SHERES SLG | hollow aluminosilicate micropheres sold by PQ Corporation having a particle size of 10–300 microns and an alumina content of at least 40% by weight based upon the weight of the micropheres. |

-continued

| | |
|---|---|
| Gating system | system through which metal is transported from the pouring cup to the mold and/or core assembly. Components of the gating system include the downsprue, runners, choke, etc. |
| Handleable | sleeve which can be transported from one place to another without sagging or breaking. |
| Insulating refractory material | a refractory material with a thermal conductivity typically less than about 0.7 W/m.K at room temperature, preferably less than about 0.5 W/m.K. |
| Insulating sleeve | a sleeve having greater insulating properties than the mold/core assembly into which it is inserted. An insulating sleeve typically contains low density materials such as fibers and/or hollow micropheres. |
| Mold assembly | an assembly of molds and/or cores made from a foundry aggregate (typically sand) and a foundry binder, which is placed in a casting assembly to provide a shape for the casting. |
| No-bake | mold or core making process which utilizes a liquid catalyst to cure the mold or core, also known as cold-curing. |
| Pouring cup | cavity into which molten metal is poured in order to fill the casting assembly. |
| Refractory | a ceramic type material, typically having a thermal conductivity greater than about 0.8 W/m.K at room temperature, which is capable of withstanding extremely high temperatures without essential change when it comes into contact with molten metal which may have a temperature as high as, for instance, 1700° C. |
| Riser | cavity connected to a mold or casting cavity of the casting assembly which acts as a reservoir for excess molten metal to prevent cavitites in the casting as it contracts on solidification. Risers may be open or blind. Risers are also known as feeders or heads. |
| Sleeve | any moldable shape having exothermic and/or insulating properties made from a sleeve composition which covers, in whole or part, any component of the casting assembly such as the riser, runners, pouring cup, sprue, etc. or is used as part of the casting assebmly. Sleeves can have a variety of shapes, e.g. cylinders, domes, cups, boards, cores. |
| Sleeve composition | any composition which is capable of providing a sleeve with exothermic and/or insulating properties. The sleeve composition will usually contain aluminum metal and/or aluminosilicate, particularly in the form of hollow aluminosilicate micropheres, or mixtures thereof. Depending upon the properties wanted, the sleeve composition may also contain alumina, refractories, an oxidizing agent, fluorides, fibers, and fillers. |
| Sleeve mix | a mixture comprising a sleeve composition and a chemical binder capable of forming a sleeve by the no-bake or cold-box process. |
| W/m. K. | a unit of thermal conductivity = watt/meter Kelvin. |

DETAILED DESCRIPTION OF FIGURES

FIG. 1 shows a simple casting assembly comprising pouring cup 1, sprue 2, runner, sleeve for side riser 4, side riser 5, sleeve for top riser 6, top riser 7, and 8 mold and/or core assembly. Molten metal is poured into the pouring cup 1 where it flows through the sprue 2 to the runner 3 and other parts of the gating system, ultimately to the 8 mold and core assembly. The risers 5, 7 are reservoirs for excess molten metal which is available when the casting cools, contracts and draws molten metal from the risers. The sleeves 4, 6, which are inserted into the mold and/or core assembly 8, surround the risers 5, 7, and keep the molten metal in the riser reservoir from cooling too rapidly.

Figure 2:
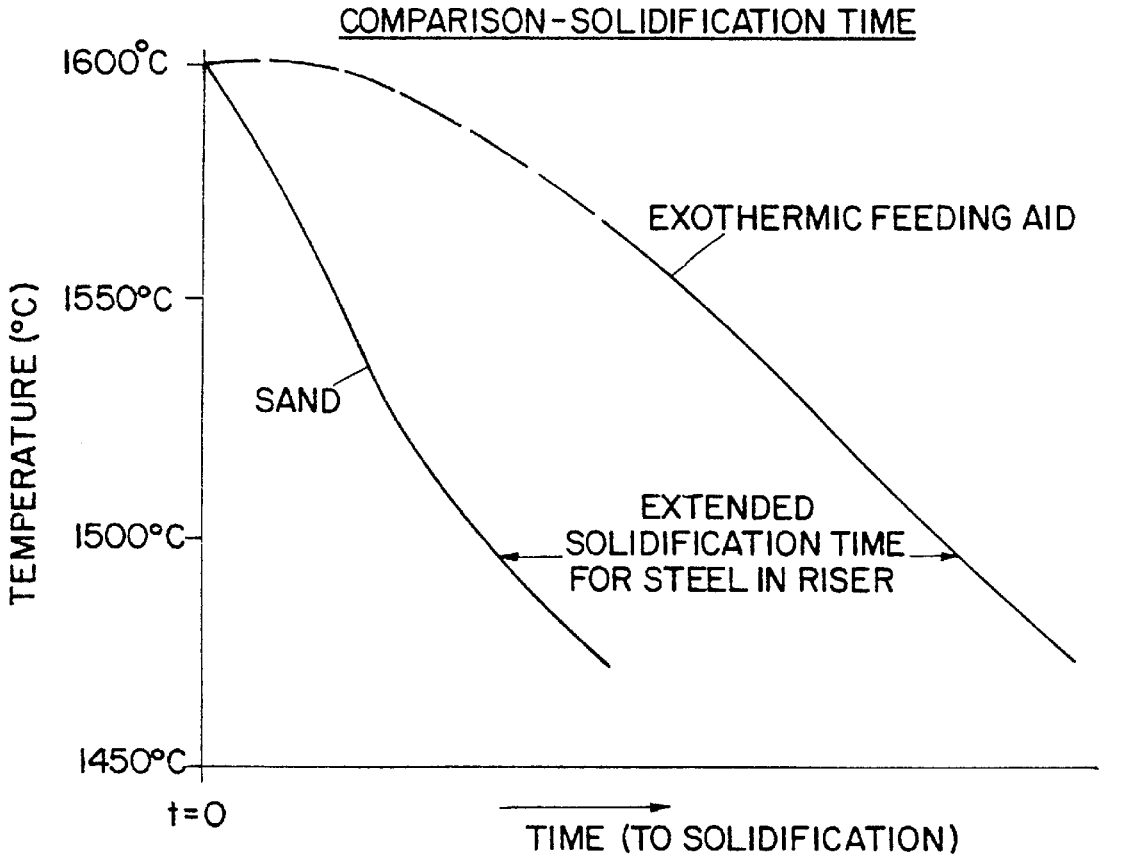
FIG. 2 graphically illustrates the effect of using a sleeve to keep the molten metal hot and liquid.

FIG. 2 graphically illustrates the beneficial effect of using a sleeve to keep the molten metal hot and liquid.

Figure 3:
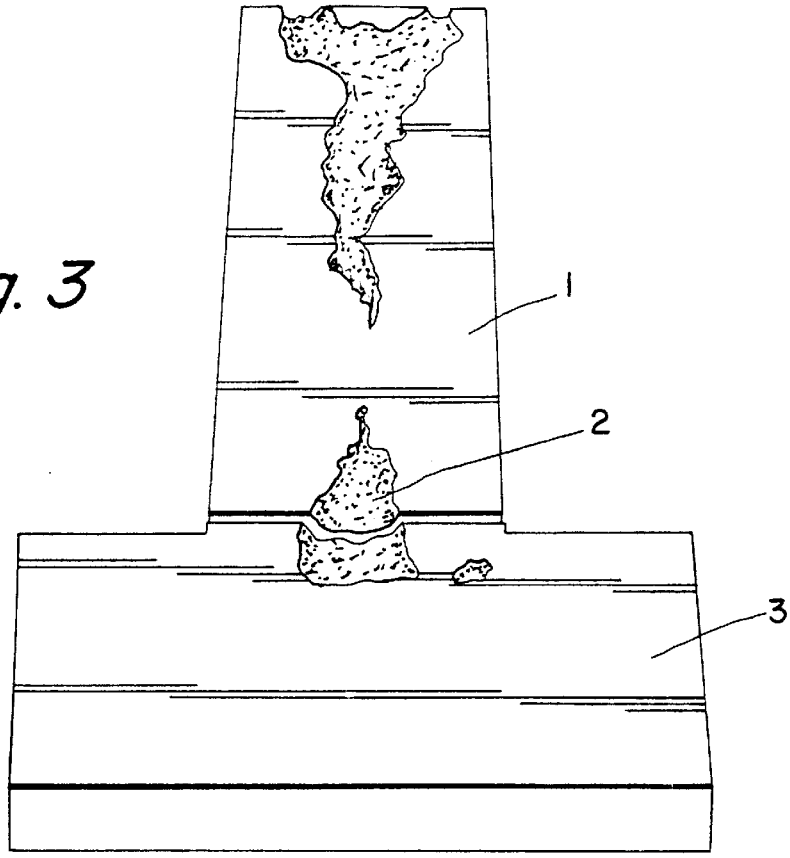
FIG. 3 shows a diagram representing a casting where shrinkage of the casting has occurred due to the inadequate thermal properties of the sleeve used. This casting is defective and will be scrapped as waste.

FIG. 3 illustrates a casting 3 where there is shrinkage 2 of the metal of the riser 1 and the metal of the casting 3. This casting is defective and will be scrapped as waste.

Figure 4:
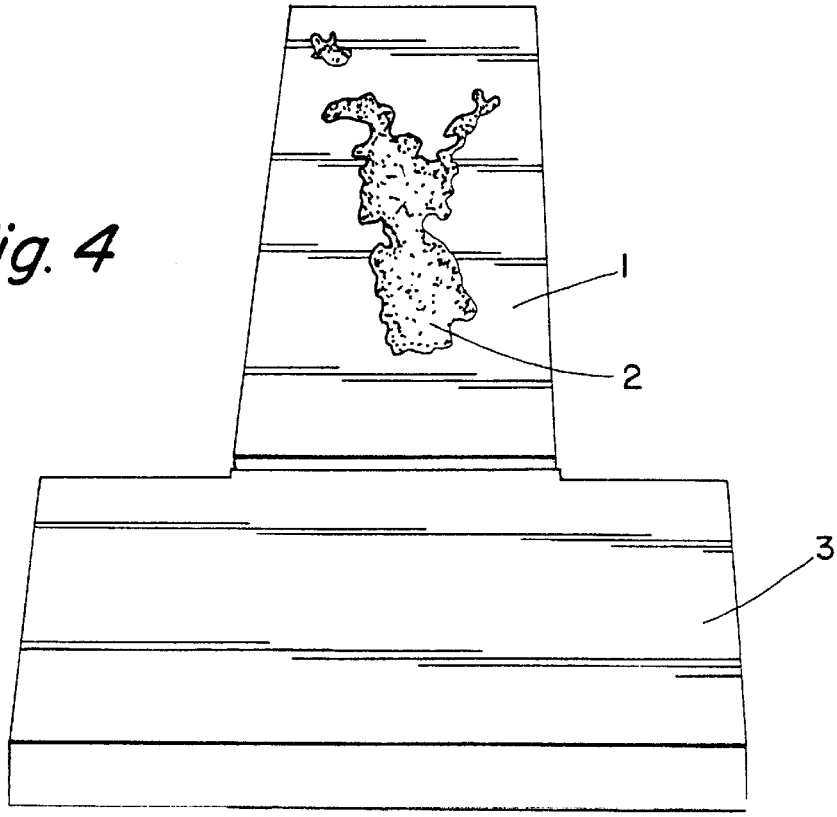
FIG. 4 is a diagram showing a casting where there has been localized shrinkage of the metal riser, but no shrinkage of the casting. This localized shrinkage does not result in casting defects and waste.

FIG. 4 illustrates a casting 3 where there is shrinkage 2 of the metal of the riser 1, but there is no shrinkage of the metal in the casting 3. This casting is not defective and can be used.

DESCRIPTION OF BEST MODE AND OTHER MODES FOR PRACTICING THE INVENTION

The sleeve mixes used in the subject process contain (1) a sleeve composition, and (2) an effective amount of chemically reactive binder. The sleeve mix is shaped and cured by contacting the sleeve with an effective amount of a curing catalyst.

There is nothing novel about the sleeve composition used for making the exothermic and/or insulating sleeves. Any sleeve composition known in the art for making sleeves can be used to make the sleeves. The sleeve composition contains exothermic and/or insulating materials, typically inorganic. The exothermic and/or insulating materials typically are aluminum-containing materials, preferably selected from the group consisting of aluminum metal, aluminosilicate, alumina, and mixtures thereof, most preferably where the aluminosilicate is in the form of hollow microspheres.

The exothermic material is an oxidizable metal and an oxidizing agent capable of generating an exothermic reaction at the temperature where the metal can be poured. The oxidizable metal typically is aluminum, although magnesium and similar metals can also be used. The insulating material is typically alumina or aluminosilicate, preferably aluminosilicate in the form of hollow microspheres.

When aluminum metal is used as the oxidizable metal for the exothermic sleeve, it is typically used in the form of aluminum powder and/or aluminum granules. The oxidizing agent used for the exothermic sleeve includes iron oxide, maganese oxide, nitrate, potassium permanganate, etc. Oxides do not need to be present at stoichiometric levels to satisfy the metal aluminum fuel component since the riser sleeves and molds in which they are contained are permeable. Thus oxygen from the oxidizing agents is supplemented by atmospheric oxygen when the aluminum fuel is burned. Typically the weight ratio of aluminum to oxidizing agent is from about 10:1 to about 2:1, preferably about 5:1 to about 4:1.

The thermal properties of the exothermic sleeve is enhanced by the heat generated which reduces the temperature loss of the molten metal in the riser, thereby keeping it hotter and liquid longer. The exotherm results from the reaction of aluminum metal which has a thermal conductivity greater than 150 W/m.K at room temperature, more typically greater than 200 W/m.K. A mold and/or core does not exhibit exothermic properties.

As was mentioned before, the insulating properties of the sleeve are preferably provided by hollow aluminosilicate microspheres, including aluminosilicate zeeospheres. The sleeves made with aluminosilicate hollow microspheres have low densities, low thermal conductivities, and excellent insulating properties. The thermal conductivity of the hollow aluminosilicate microspheres ranges from about 0.05 W/m.K to about 0.6 W/m.K at room temperature, more typically from about 0.1 W/m.K to about 0.5 W/m.K.

The insulating and exothermic properties of the sleeve can be varied, but have thermal properties which are different in degree and/or kind than the mold assembly into which they will be inserted.

Depending upon the degree of exothermic properties wanted in the sleeve, the amount of aluminum in the sleeve will range from 0 weight percent to 50 weight percent, typically 5 weight percent to 40 weight percent, based upon the weight of the sleeve composition.

Depending upon the degree of insulating properties wanted in the sleeve, the amount of hollow aluminosilicate microspheres, in the sleeve will range from 0 weight percent to 100 weight percent, typically 40 weight percent to 90 weight percent, based upon the weight of the sleeve composition. Since in most cases, both insulating and exothermic properties are needed in the sleeves, both aluminum metal and hollow aluminosilicate microspheres will be used in the sleeve. In sleeves where both insulating and exothermic properties are needed, the weight ratio of aluminum metal to hollow aluminosilicate microspheres is typically from about 1:5 to about 1:1, preferably from about 1:1 to about 1:1.5.

The hollow aluminosilicate microspheres typically have a particle size of about 3 mm. with any wall thickness. Preferred are hollow aluminosilicate microspheres having an average diameter less than 1 mm and a wall thickness of approximately 10% of the particle size. It is believed that hollow microspheres made of material other than aluminosilicate, having insulating properties, can also be used to replace or used in combination with the hollow aluminosilicate microspheres.

The weight percent of alumina to silica (as $SiO_2$) in the hollow aluminosilicate microspheres can vary over wide ranges depending on the application, for instance from 25:75 to 75:25, typically 33:67 to 50:50, where said weight percent is based upon the total weight of the hollow microspheres. It is known from the literature that hollow aluminosilicate microspheres having a higher alumina content are better for making sleeves used in pouring metals such as iron and steel which have casting temperatures of 1300° C. to 1700° C. because hollow aluminosilicate microspheres having more alumina have higher melting points. Thus sleeves made with these hollow aluminosilicate microspheres will not degrade as easily at higher temperatures.

Refractories, although not necessarily preferred in terms of performance because of their higher densities and high thermal conductivities, may be used in the sleeve composition to impart higher melting points to the sleeve mixture so the sleeve will not degrade when it comes into contact with the molten metal during the casting process. Examples of such refractories include silica, magnesia, alumina, olivine, chromite, aluminosilicate, and silicon carbide among others. These refractories are preferably used in amounts less than 50 weight percent based upon the weight of the sleeve composition, more preferably less than 25 weight percent based upon the weight of the sleeve composition. When alumina is used as a refractory, it is used in amounts of less than 50% weight percent based upon the weight of the sleeve composition, more preferably less than 10% weight percent based upon the weight of the sleeve composition.

The density of the sleeve composition typically ranges from about 0.1 g/cc to about 0.9 g/cc, more typically from about 0.2 g/cc to about 0.8 g/cc. For exothermic sleeves, the density of the sleeve composition typically ranges from about 0.3 g/cc to about 0.9 g/cc, more typically from about 0.5 g/cc to about 0.8 g/cc. For insulating sleeves, the density of the sleeve composition typically ranges from about 0.1 g/cc to about 0.7 g/cc, more typically from about 0.3 g/cc to about 0.6 g/cc.

In addition, the sleeve composition may contain different fillers and additives, such as cryolite ($Na_3AlF_6$), potassium aluminum tetrafluoride, potassium aluminum hexafluoride.

The binders that are mixed with the sleeve composition to form the sleeve mix are well know in the art. Any no-bake or cold-box binder, which will sufficiently hold the sleeve mix together in the shape of a sleeve and polymerize in the presence of a curing catalyst, will work. Examples of such binders are phenolic resins, phenolic urethane binders, furan binders, alkaline phenolic resole binders, and epoxy-acrylic binders among others. Particularly preferred are epoxy-acrylic and phenolic urethane binders known as EXACT-CAST™ cold-box binders sold by Ashland Chemical Company. The phenolic urethane binders are described in U.S. Pat. Nos. 3,485,497 and 3,409,579, which are hereby incorporated into this disclosure by reference. These binders are based on a two part system, one part being a phenolic resin component and the other part being a polyisocyanate component. The epoxy-acrylic binders cured with sulfur dioxide in the presence of an oxidizing agent are described in U.S. Pat. No. 4,526,219 which is hereby incorporated into this disclosure by reference.

The amount of binder needed is an effective amount to maintain the shape of the sleeve and allow for effective curing, i.e. which will produce a sleeve which can be handled or self-supported after curing. An effective amount of binder is greater than about 4 weight percent, based upon the weight of the sleeve composition. Preferably the amount of binder ranges from about 5 weight percent to about 15 weight percent, more preferably from about 6 weight percent to about 12 weight percent.

Curing the sleeve by the no-bake process takes place by mixing a liquid curing catalyst with the sleeve mix (alternatively by mixing the liquid curing catalyst with the sleeve composition first), shaping the sleeve mix containing the catalyst, and allowing the sleeve shape to cure, typically at ambient temperature without the addition of heat. The preferred liquid curing catalyst is a tertiary amine and the preferred no-bake curing process is described in U.S. Pat. No. 3,485,797 which is hereby incorporated by reference into this disclosure. Specific examples of such liquid curing catalysts include 4-alkyl pyridines wherein the alkyl group has from one to four carbon atoms, isoquinoline, arylpyridines such as phenyl pyridine, pyridine, acridine, 2-methoxypyridine, pyridazine, 3-chloro pyridine, quinoline, N-methyl imidazole, N-ethyl imidazole, 4,4'-dipyridine, 4-phenylpropylpyridine, 1-methylbenzimidazole, and 1,4-thiazine.

Curing the sleeve by the cold-box process takes place by blowing or ramming the sleeve mix into a pattern and contacting the sleeve with a vaporous or gaseous catalyst. Various vapor or vapor/gas mixtures or gases such as tertiary amines, carbon dioxide, methyl formate, and sulfur dioxide can be used depending on the chemical binder chosen. Those skilled in the art will know which gaseous curing agent is appropriate for the binder used. For example, an amine vapor/gas mixture is used with phenolic-urethane resins.

Sulfur dioxide (in conjunction with an oxidizing agent) is used with an epoxy-acrylic resins. See U.S. Pat. No. 4,526,219 which is hereby incorporated into this disclosure by reference. Carbon dioxide (see U.S. Pat. No. 4,985,489 which is hereby incorporated into this disclosure by reference) or methyl esters (see U.S. Pat. No. 4,750,716 which is hereby incorporated into this disclosure by reference) are used with alkaline phenolic resole resins. Carbon dioxide is also used with binders based on silicates. See U.S. Pat. No. 4,391,642 which is hereby incorporated into this disclosure by reference.

Preferably the binder is an EXACTCAST™ cold-box phenolic urethane binder cured by passing a tertiary amine gas, such a triethylamine, through the molded sleeve mix in the manner as described in U.S. Pat. No. 3,409,579, or the epoxy-acrylic binder cured with sulfur dioxide in the presence of an oxidizing agent as described in U.S. Pat. No. 4,526,219. Typical gassing times are from 0.5 to 3.0 seconds, preferably from 0.5 to 2.0 seconds. Purge times are from 1.0 to 60 seconds, preferably from 1.0 to 10 seconds.

EXAMPLES

In all of the examples which follow, the binder used was either a no-bake or cold-box phenolic-urethane binder as specified where the ratio of Part I to Part II was 55/45. The sleeve mixes were prepared by mixing the sleeve composition and the binder in a Hobart N-50 mixer for about 2–4 minutes. In the no-bake sleeve compositions, the liquid curing catalyst is added to the sleeve mix before shaping. The sleeves prepared were cylindrical sleeves 90 mm in internal diameter, 130 mm in external diameter, and 200 mm in height. The amount of binder used in all cases, except in Comparison Example A, was 8.8 weight percent based upon the weight of the sleeve composition. All lettered Examples are controls where silica sand was used as the sleeve composition. All parts are by weight and all percentages are weight percentages based upon the weight of the sleeve composition unless otherwise specified.

Comparison Example A

Sleeve Formed from Silica Sand

One hundred parts of silica sand were used as the sleeve composition which was mixed with about 1.3 weight percent of EXACTCAST™ no-bake binder to form a sleeve mix. Then about 1 weight percent of a liquid tertiary amine, POLYCAT 41 catalyst[1], sold by Air Products, is added to the sleeve mix. The resulting mix is shaped into cylindrical sleeves.

The tensile properties of the sleeves, which indicates the strength of the sleeves for handling, are measured and set forth in Table I which follows. The tensile strengths of the sleeves are measured immediately (30 minutes), 1 hour, 4 hours, 24 hours, and 24 hours at 100% relative humidity (RH) after removing from the corebox.

Although the tensile strengths were good, steel castings made with the sleeves experienced shrinkage which is represented by FIG. 3. The shrinkage occurred because the thermal properties were not adequate for sleeve applications. These castings were defective and were scrapped.

Example 1

Preparation of Insulating Sleeve by No-Bake Method

The no-bake process of Comparison Example A was followed except 100 parts of SG EXTENDOSPHERES were used as the sleeve composition and mixed with 8.8% of EXACTCAST™ no-bake binder to form a sleeve mix. Then about 1 weight percent of a liquid tertiary amine, POLYCAT 41 catalyst is added to the sleeve mix. The resulting mix is shaped into a sleeve.

The tensile properties of the sleeves, which indicates the strength of the sleeves for handling, are measured and set forth in Table I which follows. The tensile strengths of the sleeves are measured immediately (30 minutes), 1 hour, 4 hours, 24 hours, and 24 hours at 100% relative humidity (RH) after removing from the corebox.

The sleeves are dimensionally accurate, both externally and internally.

Example 2

Preparation of Insulating Sleeve Containing Hollow Aluminosilicate Microspheres by Cold-Box Method One hundred parts of SG EXTENDOSPHERES were used as the sleeve composition and mixed with 8.8% of EXACTCAST™ cold-box binder to form a sleeve mix. The sleeve mix of Example 1 is blown into a pattern having the shape of a sleeve and gassed with triethylamine in nitrogen at 20 psi according to known methods described in U.S. Pat. No. 3,409,579. Gas time is 2.5 second, followed by purging with air at 60 psi for about 60.0 seconds.

The tensile strengths of the cured sleeves are measured as in Example 1 except the immediate tensile strength was measured 30 seconds after removing from the corebox. The tensile strengths of the sleeves are set forth in Table I. The sleeves are dimensionally accurate, both externally and internally.

Example 3

Example 2 with Silicone Resin

Example 2 was followed except 1.2 weight percent of silicone resin was added to the sleeve mix. The tensile strength of the cured sleeves are measured as in Example 2. The tensile strengths of the sleeves are set forth in Table I. The sleeves are dimensionally accurate, both externally and internally.

Example 4

Preparation of Exothermic Sleeve by the Cold-Box Method

The procedure of Example 2 was followed except the sleeve composition used consisted of 55% SLG EXTENDOSHPERES, 16.5% atomized aluminum, 16.5% aluminum powder, 7% magnetite, and 5% cryolite. The tensile strengths of the cured sleeves are measured as in Example 2. The tensile strengths of the sleeves are set forth in Table I. The sleeves are dimensionally accurate, both externally and internally.

Example 5

Preparation of Exothermic Sleeve Containing Silica by the No-Bake Method

The procedure of Example 1 was followed except the sleeve composition used consisted of 50% Wedron 540 silica sand, 10% alumina, and 40% of the sleeve mix of Example 4. The tensile strengths of the cured sleeves are measured as in Example 1. The tensile strengths of the sleeves are set forth in Table I. The sleeves are dimensionally accurate, both externally and internally.

Example 6

Preparation of Exothermic Sleeve Containing Silica by the Cold-Box Method.

The procedure of Example 2 was followed except the sleeve composition used consisted of 50% Wedron 540 silica sand, 10% alumina, and 40% of the sleeve mix of Example 4. The tensile strengths of the cured sleeves are measured as in Example 2. The tensile strengths of the sleeves are set forth in Table I. The sleeves are dimensionally accurate, both externally and internally.

Example 7

Sleeve Composition

A sleeve composition is prepared by mixing the following components in a Hobart N-50 mixer for about 4 minutes:

50% silica sand,

10% iron oxide,

10% alumina,

3% sodium nitrate,

20% aluminum powder, and

2% sawdust.

The sleeve composition is used to prepare cylindrical sleeves by the no-bake or cold-box method. Exothermic and insulating properties of the sleeves are varied by changing the amount of aluminum metal and alumina.

TABLE I (Properties of Test Shapes)

| EXAMPLE | SLEEVE | TENSILE STRENGTHS OF SLEEVES Imm. | 1 hour | 4 hours | 24 hours | @ 100% RH | DIM. ACC. |
|---|---|---|---|---|---|---|---|
| Comparison B | A | 208 | 224 | 250 | 290 | 59 | accurate |
| 9 | 1 | 41 | 119 | 129 | 132 | 65 | accurate |
| 10 | 2 | 133 | 183 | 193 | 212 | 147 | accurate |
| 11 | 3 | 140 | 208 | 220 | 232 | 230 | accurate |
| 12 | 5 | 88 | 69 | 105 | 96 | 88 | accurate |
| 13 | 6 | 41 | 101 | 99 | 129 | 70 | accurate |
| 14 | 7 | 99 | 140 | 106 | 144 | 125 | accurate |

EXAMPLES 15–20

In Comparison Example C, and Examples 15–20, the sleeves of Comparison Example A and Examples 1–6 are tested in a casting assembly by using them to surround the top riser of the casting assembly. The metal poured into the casting assembly is steel (carbon content of 0.13%) and is poured at a temperature of 1650° C. The casting of Comparison Example C, made using the sleeve from Comparison Example A, experienced shrinkage and resulted in a defective casting which was scrapped as waste. The castings of Examples 15–20, made with sleeves 1–7, did not shrink as FIG. 4 illustrates. FIG. 4 shows some shrinkage of the riser above the casting, but there was no shrinkage of the casting. In all cases, where the sleeves were made by the cold-box and no-bake process, there was no shrinkage of the casting. These results are summarized in Table II which follows.

TABLE II

CASTING RESULTS

| EXAMPLE | SLEEVE | CASTING RESULTS |
|---|---|---|
| Comparison C | A | Shrinkage of casting resulting in casting defect and waste. |
| 15 | 1 | No shrinkage of casting. No waste or casting defect resulted. |
| 16 | 2 | No shrinkage of casting. No waste or casting defect resulted. |
| 17 | 3 | No shrinkage of casting. No waste or casting defect resulted. |
| 18 | 4 | No shrinkage of casting. No waste or casting defect resulted. |
| 19 | 6 | No shrinkage of casting. No waste or casting defect resulted. |
| 20 | 7 | No shrinkage of casting. No waste or casting defect resulted. |

What is claimed is:

1. A cold-box process for preparing a sleeve having exothermic properties comprising:

(A) introducing an exothermic sleeve mix into a pattern to form an uncured sleeve wherein said exothermic sleeve mix comprises:

(1) a sleeve composition comprising an oxidizable metal and an oxidizing agent capable of generating an exothermic reaction; and (2) an effective binding amount of a chemically reactive organic cold-box binder;

(B) contacting the uncured sleeve formed with the exothermic sleeve mix with a volatile curing catalyst; and (C) allowing said sleeve resulting from (B) to cure until said sleeve becomes handleable.

2. The process of claim 1 wherein the oxidizable metal is aluminum.

3. The process of claim 2 wherein the amount of aluminum in the sleeve composition is from 5 weight percent to 40 weight percent based upon the weight of the sleeve composition.

4. The process of claim 3 wherein the aluminum metal comprises aluminum powder.

5. The process of claim 4 wherein the organic cold-box binder level is from about 5 weight percent to about 15 weight percent based upon the weight of the sleeve composition.

6. The process of claim 5 wherein the sleeve composition also contains an aluminosilicate material.

7. The process of claim 6 wherein aluminosilicate material is in the form of hollow aluminosilicate microspheres.

8. The process of claim 7 wherein the weight ratio of aluminum to hollow aluminosilicate microspheres is from 1:5 to 1:1.

9. The process of claim 8 wherein the organic cold-box binder comprises a phenolic urethane binder.

10. The process of claim 8 wherein the organic cold-box binder comprises an epoxy-acrylic binder.

11. The process of claim 9 wherein the volatile curing catalyst is a tertiary amine.

12. The process of claim 11 wherein the oxidizing agent is iron oxide.

13. A sleeve prepared by the process of claim 1, 2, 3, 4, 5, 6, 7, 8, 9, 10, 11, or 12.

14. A process for preparing a casting comprising:

A. inserting an exothermic sleeve of claim 13 into a casting assembly comprising a mold assembly;

B. pouring metal, while in the liquid state, into said casting assembly;

C. allowing said metal to cool and solidify; and

D. separating the casting from the casting assembly.

15. A casting prepared by the process of claim 14.

16. A cold-box process for preparing a sleeve having insulating properties comprising:

A. introducing an insulating sleeve mix into a pattern to form an uncured insulating sleeve wherein said insulating sleeve mix comprises:

(1) an insulating refractory material having an average particle diameter of less than 1 millimeter;

(2) an effective binding amount of a chemically reactive organic cold-box binder;

C. contacting the uncured insulating sleeve with a gaseous curing catalyst; and

D. allowing said sleeve resulting from (B) to cure until said sleeve becomes handleable.

17. The process of claim 16 wherein the thermal conductivity of the insulating sleeve mix is from about 0.05 W/m.K to about 0.6 W/m.K at room temperature.

18. The process of claim 17 wherein the density of the sleeve mix is from about 0.1 g/cc to about 0.9 g/cc.

19. The process of claim 18 wherein the insulating sleeve composition comprises an aluminosilicate material.

20. The process of claim 19 wherein aluminosilicate material comprises hollow aluminosilicate microspheres and is present in an amount of from 40 weight percent to 100 weight percent based upon the weight of the sleeve composition.

21. The process of claim 20 wherein the binder level is from about 5 weight percent to about 15 weight percent based upon the weight of the sleeve composition.

22. The process of claim 21 wherein the organic cold-box binder comprises a phenolic urethane binder.

23. The process of claim 21 wherein the organic cold-box binder comprises an epoxy-acrylic binder.

24. The process of claim 22 wherein the volatile curing catalyst is a tertiary amine.

25. A sleeve prepared according to claim 16, 17, 18, 19, 20, 21, 22, 23, or 24.

26. A process for preparing a casting comprising:

A. inserting an insulating sleeve of claim 25 into a casting assembly comprising a mold assembly;

B. pouring metal, while in the liquid state, into said casting assembly;

C. allowing said metal to cool and solidify; and

D. separating the casting from the casting assembly.

27. A casting prepared by the process of claim 26.

* * * * *

UNITED STATES PATENT AND TRADEMARK OFFICE

CERTIFICATE OF CORRECTION

PATENT NO. : 6,133,340
DATED : October 17, 2000
INVENTOR(S) : Paulo Roberto Menon It is certified that error appears in the above-identified patent and that said Letters Patent is hereby corrected as shown below:

Column 13,
Line 29, replace “C” with -- B --.
Line 31, replace “D” with -- C --.

Signed and Sealed this

Nineteenth Day of August, 2003

JAMES E. ROGAN
*Director of the United States Patent and Trademark Office*